United States Patent [19]

Hillstrom et al.

[11] 4,253,911

[45] Mar. 3, 1981

[54] PROCESS FOR MAINTAINING A LOW SODIUM CHLORIDE CONTENT IN RECYCLED SODIUM CHEMICALS OF SODIUM-BASED PULP MANUFACTURING PROCESSES

[75] Inventors: Per A. R. Hillstrom, Domsjo; Kent I. Sondell, Ornskoldsvik, both of Sweden

[73] Assignee: Mo och Domsjo Aktiebolag, Ornskoldsvik, Sweden

[21] Appl. No.: 771,705

[22] Filed: Feb. 24, 1977

[30] Foreign Application Priority Data

Nov. 15, 1976 [SE] Sweden ..... 7612743

[51] Int. Cl.[3] ..... D21C 11/02; D21C 11/04

[52] U.S. Cl. ..... 162/30 R; 162/36; 162/DIG. 8; 162/30 K; 162/33; 423/DIG. 3

[58] Field of Search ..... 162/30 R, 30 K, DIG. 8, 162/36, 33; 423/422, 209, DIG. 3

[56] References Cited

U.S. PATENT DOCUMENTS

| | | | |
|---|---|---|---|
| 1,915,315 | 6/1933 | Hoffman | 162/33 |
| 2,909,407 | 10/1959 | Ahlborg et al. | 423/209 |
| 3,650,888 | 3/1972 | Fogman et al. | 162/30 R |
| 3,826,710 | 7/1974 | Anderson | 162/36 |
| 3,909,344 | 9/1975 | Lukes | 162/30 K |
| 3,996,097 | 12/1976 | Fuller | 162/DIG. 8 |

FOREIGN PATENT DOCUMENTS

| | | | |
|---|---|---|---|
| 928008 | 6/1973 | Canada | 162/DIG. 8 |

*Primary Examiner*—William F. Smith

[57] ABSTRACT

A process is provided for the separation of sodium chloride in the sodium chemicals recovery stage of sodium-based pulp manufacturing processes so as to maintain a low sodium chloride content in the recycled sodium chemicals, comprising the steps of treating an aqueous sodium chloride-containing solution with carbon dioxide gas, thereby forming a saturated sodium bicarbonate solution; precipitating sodium values of the solution as sodium bicarbonate while retaining sodium chloride in solution; separating such sodium bicarbonate; withdrawing the residual aqueous sodium chloride-containing solution from the process; and recycling the separated sodium bicarbonate.

9 Claims, 3 Drawing Figures

PROCESS FOR MAINTAINING A LOW SODIUM CHLORIDE CONTENT IN RECYCLED SODIUM CHEMICALS OF SODIUM-BASED PULP MANUFACTURING PROCESSES

The main source of environmental pollution from sodium-based pulp manufacturing processes is the waste liquors discharged from the washing, bleaching and evaporation stages of the process. The waste liquors from the washing and evaporation stages can be processed in a manner to recover the chemicals content thereof and the recovered chemicals recycled, so that the discharge of these waste liquors to lakes and streams is unnecessary, but the chemicals recovery procedures for waste bleaching liquors and particularly chloride-containing waste bleaching liquors are not satisfactory.

One way for recovering the chemicals content of waste bleaching liquors is to combust the liquors. However when bleaching is carried out with chlorine-containing bleaching agents, the spent bleaching liquors contain large amounts of sodium chloride. Sodium chloride is also introduced into the liquor circulating in a sodium-based pulp manufacturing system with the wood, particularly when the wood has been transported and/or stored in the sea. Sodium chloride can also be introduced into the system from the residual acid obtained in the preparation of chlorine dioxide by reduction of sodium chlorate with sulfur dioxide.

The amounts of chlorides introduced into the system from these sources can be considerable, as shown in Table I.

TABLE I

| NaCl Source | | Amount of Sodium Chloride Introduced (kg of NaCl/ton pulp) |
|---|---|---|
| Residual acid from $ClO_2$ manufacture | | 0.2 |
| Wood land-transported | | 0.1 |
| Wood sea-stored | | 2.0 |
| Spent bleaching liquor from: | | |
| Bleaching sequence | Kappa number after digestion | |
| C E H D E D | 35 | 155 |
| D E D E D | 35 | 36 |
| D E D E D | 22 | 26 |
| O C/D E D E D[1] | 17 | 67 |
| O D E D E D | 17 | 22 |

[1]Ratio of active chlorine in C/D stage 85:15

It is apparent from the above that if spent sodium chloride-containing bleaching liquors are run through the chemicals recovery system the chloride content of the recycled chemicals will increase tenfold.

Table II shows the sodium chloride content in white liquor in a sodium-based sulfate pulp mill, at differing amounts of sodium chloride introduced, and differing efficiencies in sodium chemicals recovery (measured as loss of $Na_2SO_4$):

TABLE II

| Amount of Sodium Chloride Introduced (kg/ton pulp) | Sodium Chloride Content in White Liquor from Chemicals Recovery | | |
|---|---|---|---|
| | At $Na_2SO_4$ loss of 45 kg/ton pulp | At $Na_2SO_4$-loss of 30 kg/ton pulp | At $Na_2SO_4$ loss of 10 kg/ton pulp |
| 0 | 0 | 0 | 0 |
| 2 | 12 | 17 | 50 |
| 5 | 28 | 42 | 125 |
| 10 | 56 | 82 | — |

TABLE II-continued

| Amount of Sodium Chloride Introduced (kg/ton pulp) | Sodium Chloride Content in White Liquor from Chemicals Recovery | | |
|---|---|---|---|
| | At $Na_2SO_4$ loss of 45 kg/ton pulp | At $Na_2SO_4$-loss of 30 kg/ton pulp | At $Na_2SO_4$ loss of 10 kg/ton pulp |
| 15 | 83 | 122 | — |

It is apparent from the above that if no measures are taken to reduce the sodium chloride content of the recycled chemicals, the sodium chloride content in the white liquor even at low $Na_2SO_4$ recovery efficiency very quickly rises to an unacceptable level. High sodium chloride contents in the recycled chemicals cannot be tolerated because sodium chloride is corrosive, and the higher the concentration of sodium chloride in the liquor formed from the regenerated chemicals the greater the attack on the equipment.

A normal and acceptable low sodium chloride content in white liquor in sodium sulfate pulping mills is from 1 to 10 g per liter. This low sodium chloride content in the past has been maintained simply by discharging the spent liquors from the bleachery into lakes and streams, but with increasing governmental restrictions on such discharges, with a view towards protection of the environment, it is no longer possible.

Accordingly, it has become necessary for the sulfate pulp manufacturer to adopt some technical modification of the pulp manufacturing and chemicals recovery process that will make it possible to reduce the chloride content of the recycled chemicals without waste discharges. Several methods are known, but none is fully satisfactory, and all add materially to operating costs.

In one method, sodium chloride is leached from the dust collected in the electrostatic filters for separating such dust from the flue gases in the soda boiler. As the leaching liquor, a recycled aqueous solution containing sodium chloride and sodium sulfate is used.

In another method, the hydrogen chloride gas present in the flue gases from the soda boiler is scrubbed out before the flue gas is treated to absorb sulfur dioxide gas.

The amounts of sodium chloride that can be removed from the system using these two methods, separately or combination, is not very great. Table III shows the amount that can be removed if the sodium chloride content in the white liquor is about 10 g/liter.

TABLE III

| | Leaching (95% efficiency) | Scrubbing (80% efficiency) | Leaching and scrubbing |
|---|---|---|---|
| Removable NaCl (kg/ton pulp) | 2.2 | 2.6 | 4.9 |

These methods clearly do not remove sufficient sodium chloride to make it possible to burden the chemicals recovery system with the chemicals in waste bleaching liquors. A higher sodium chloride removal rate is needed, to maintain a low sodium chloride content in this case, since the system would otherwise quickly become overloaded with sodium chloride.

It has accordingly been proposed to separate sodium chloride from the smelt obtained in the chemicals recovery boiler. This smelt normally contains sodium carbonate, sodium sulfide, sodium sulfate, sodium thiosulfate, sodium hydroxide and sodium chloride. The sodium chloride is separated by some physical technique, such as by fractional crystallization or by fractional dissolution, in such a manner that sodium chloride is somehow separated from the other sodium salts that are present.

One of these fractionation processes takes advantage of the fact that sodium sulfide is readily soluble by first separating sodium sulfide by leaching or dissolution, or by crystallization. Samuelson Canadian Pat. No. 928,008, suggests the evaporation and combustion of waste bleaching liquors combined with spent pulping liquor. The combustion residue is then subjected to a fractional dissolution at a temperature above 40° C. with an amount of water sufficient to dissolve the sodium sulfate but insufficient to dissolve sodium chloride and sodium carbonate. Sodium chloride is then separated by taking up the solid residue in water, and precipitating sodium carbonate decahydrate at temperatures below 20° C. This can be done also by leaching the solid residue at a low temperature with water.

It is also possible first to dissolve the combustion residue completely, then evaporate the solution to the stage at which precipitation of sodium carbonate and sodium chloride takes place, and then separate the sodium chloride from the sodium carbonate either by fractional dissolution at low temperature or by dissolution and then fractional precipitation at low temperature. In this procedure, valuable sodium carbonate is inevitably lost, and the water balance is disturbed, while at the same time considerable energy is required to carry out the fractional precipitation and/or leaching processes at low temperatures, which are in fact below normal room temperature.

Lukes U.S. Pat. No. 3,909,344, patented Sept. 30, 1975, proposes a rather similar method. The smelt from the spent pulping liquor recovery operation is dissolved in water at an elevated temperature and is then evaporatively cooled to crystallized hydrated sodium carbonate, while inhibiting precipitation of sodium chloride. The precipitated sodium carbonate is then separated, together with other crystallized salts, for example, sodium sulfide and sodium sulfate, and the mother liquor is then evaporated with heating to precipitate sodium chloride. The sodium carbonate may be causticized to sodium hydroxide, and recycled.

In a variation of this process, Lukes et al Canadian Pat. No. 495,088 first separates readily soluble sodium sulfide from the smelt, for instance by leaching at a temperature above 50° C., and this sodium sulfide solution is recycled. The residual solid mixture of sodium carbonate, sodium sulfate and sodium chloride is then leached at a high temperature, preferably at 100° C., at which the solubility of sodium chloride is higher than that of sodium carbonate. The resulting solution containing sodium chloride and some sodium sulfate and sodium carbonate is cooled to precipitate sodium chloride, which is then removed from the chemicals recovery system.

In another approach, Lukes et al Canadian Pat. No. 494,897 dissolves readily soluble sodium sulfide from the smelt by leaching at above 50° C., and this sodium sulfide is then recycled. The residual solid mixture is then leached at about 20° C., so as to dissolve sodium carbonate and sodium sulfate, while leaving behind sodium chloride, and the residue is then separated from the recovery process. From the solution of sodium carbonate and sodium sulfate, the salts are precipitated by cooling, and then causticized to sodium hydroxide, which is recycled.

These procedures do not give an effective separation of sodium carbonate and sodium chloride, because the differences in solubility between these salts at temperatures from 0° to 100° C. is very small, as Table IV shows:

TABLE IV

| Temperature °C. | Solubility g per 100 g solution $Na_2CO_3$ | NaCl | Solid phase precipitated |
|---|---|---|---|
| 0 | 2.8 | 24.2 | $Na_2CO_3 \cdot 10\ H_2O$ and NaCl |
| 20 | 13.5 | 17.4 | $Na_2CO_3 \cdot 10\ H_2O$ and NaCl |
| 60 | 13.9 | 17.8 | $Na_2CO_3 \cdot 1\ H_2O$ and NaCl |
| 100 | 9.9 | 22.5 | $Na_2CO_3 \cdot 1\ H_2O$ and NaCl |

Thus, these approaches give a relatively high concentration of sodium chloride in the white liquor, nonetheless.

*Rapson Pulp and Paper Magazine of Canada* 71 No. 13, July 13, 1970, pp 43 to 54 suggests a modified five-step process, which includes (1) leaching the smelt from the soda recovery boiler with concentrated sulfide-lean white liquor to dissolve sodium sulfide;

(2) dissolving the solid residue containing sodium carbonate and sodium chloride in waste bleaching liquor and recycled sodium chloride sodium carbonate solution to form sulfide-lean green liquid; and causticizing the resulting solution with calcium hydroxide to form white liquor;

(3) concentrating the resulting white liquor until sodium chloride plus some sodium carbonate precipitate;

(4) leaching the precipitate with water, so as to dissolve all of the sodium carbonate and a part of the sodium chloride. The major amount of sodium chloride is left behind as a crystalline residue, which is then removed from the process; and (5) using the leaching solution plus bleaching plant effluent to dissolve sodium carbonate/sodium chloride residue from the smelt in (2).

This process has high energy requirements, and the evaporators moreover must evaporate a concentrated sodium chloride/sodium carbonate solution, which poses difficulties such as corrosion problems. Moreover, the resulting concentrated white liquor still has a relatively high sodium chloride content, of the order of about 20 g of sodium chloride per liter.

There are three Rapson and Reeve patents that cover aspects of the overall process described in the Rapson and Reeve article.

Rapson and Reeve U.S. Pat. No. 3,740,307, patented June 19, 1973, suggests preparing a green liquor from the smelt containing sodium carbonate and sodium chloride. The green liquor is causticized to convert the sodium carbonate content substantially to sodium hydroxide, sodium chloride, and sodium carbonate. The resulting white liquor is then concentrated to precipitate sodium chloride and unreacted sodium carbonate therefrom, and the precipitated sodium carbonate and at least part of the sodium chloride is then taken up in an aqueous solution, which is used in the preparation of the green liquor. The bleaching plant effluent, together with the recycled sodium carbonate and sodium chloride solution, is used to dissolve the smelt to form green liquor, or to dilute an already formed green liquor.

The waste bleaching liquor also can be used to leach the precipitated mixture of sodium chloride and sodium carbonate from the concentrated white liquor, to dissolve the sodium carbonate and part of the sodium chloride to form the recycled solution. The waste bleaching liquor can also be used to wash the calcium carbonate mud deposited in the causticization step, and to wash the dregs. Further, the waste bleaching liquor can be used to dilute concentrated white liquor prior to recycle to the digester. In these ways, the waste bleaching liquor can be recovered, and need not be discharged to the environment.

Rapson and Reeve U.S. Pat. No. 3,740,308, patented June 19, 1973, recover the sodium chloride by fractionating the sodium sulfide- and sodium chloride-containing smelt to obtain an aqueous solution of sodium sulfide, and leave a solid deposit containing the sodium chloride. The smelt may be leached with water or recycled sodium sulfide solution to dissolve sodium sulfide preferentially, and leave sodium carbonate and sodium chloride. Aqueous sodium hydroxide solution can also be used to fractionate the sodium sulfide-containing smelt, to form a sodium hydroxide- and sodium sulfide-containing white liquor. The smelt may also be fractionated by contact with dilute aqueous sodium hydroxide solution, or dilute sulfide-lean white liquor, thereby forming pulping liquor.

Another manner of fractionating the sodium sulfide from the smelt is to prepare the green liquor in the conventional manner and then evaporate water to precipitate sodium carbonate and sodium chloride. Sodium chloride can then be separated from the resulting mixture by leaching the mixture with water to dissolve the sodium carbonate together with part of the sodium chloride, leaving pure sodium chloride behind, which can then be removed from the process.

Alternatively, the white liquor may be subjected to a two-stage evaporative crystallization. In the first stage, sodium sulphate and sodium carbonate is precipitated, and then, later on, a mixture of sodium carbonate and sodium chloride is precipitated, which can be removed from the process.

Rapson and Reeve U.S. Pat. No. 3,746,612, patented July 17, 1973, forms a white liquor for pulping having a reduced sodium chloride content by subjecting dilute white liquor to concentration, to deposit sodium chloride therefrom. In this way, sodium chloride is removed from the system.

In the "Stora" recovery system, described in U.S. Pat. No. 2,909,407, the smelt containing sodium carbonate, sodium chloride and sodium sulfide is dissolved in water, and the resulting solution is treated with carbon dioxide gas at elevated temperatures to drive off a mixture of carbon dioxide and hydrogen sulfide, as a result of which a solution of sodium bicarbonate and sodium carbonate is obtained. This solution is then reacted with sodium bisulfite, resulting in the formation of sodium sulfite and carbon dioxide. The mixture of carbon dioxide and hydrogen sulfide gas is reacted with sulfur dioxide in a Claus reactor to form molten sulfur and carbon dioxide containing small amounts of sulfur dioxide, which can be recycled. The molten sulfur is combusted to sulfur dioxide, which is absorbed in water, and again withdrawn as concentrated sulfur dioxide, for recycling to the Claus reactor, and also for reaction with sodium sulfite in the formation of sodium bisulfite.

In accordance with the invention a process is provided for the separation of sodium chloride in the sodium chemicals recovery stage of sodium-based pulp manufacturing processes so as to maintain low sodium chloride content in the recycled sodium chemicals, comprising the steps of treating an aqueous sodium chloride-containing solution of sodium chemicals with carbon dioxide gas, thereby forming a saturated sodium bicarbonate solution; precipitating sodium values of the solution as sodium bicarbonate while retaining sodium chloride in solution; separating such sodium bicarbonate; withdrawing residual aqueous sodium chloride-containing solution from the process; and recycling the separating sodium bicarbonate to the process.

The Figures represent flow sheets showing the steps of various embodiments of this process.

Figure 1:
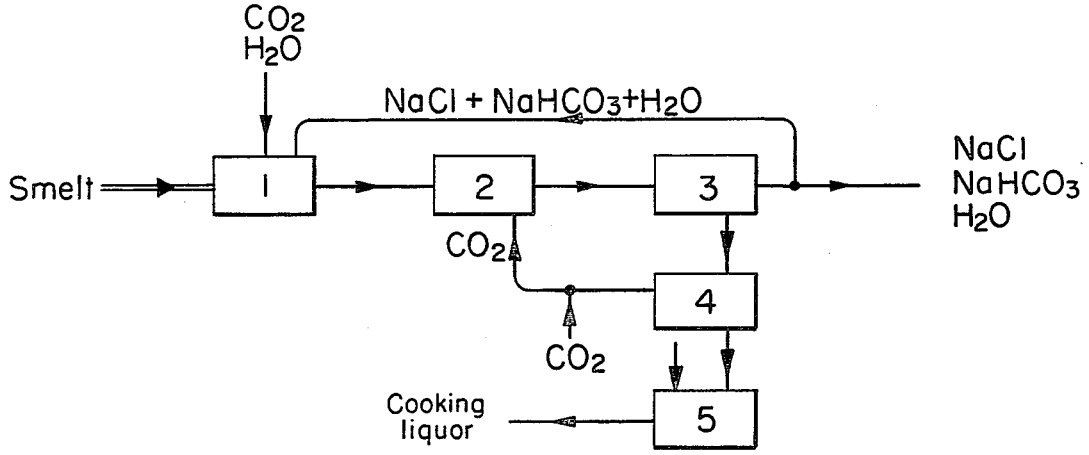
FIG. 1 is a flow sheet showing application of the process of the invention to a sodium hydroxide or soda pulping process.

The flow sheet of FIG. 1 shows application of the process to a sulfide-free smelt obtained by recovery of the chemicals content of the washing liquor from the filters in a sodium hydroxide or soda pulping process when using waste liquor from the bleachery as washing liquor in the brown stock washing. The liquor is evaporated and burned in a soda boiler, and the smelt is composed mainly of sodium carbonate and sodium chloride.

In the first stage of the process of the invention, this sodium carbonate/sodium chloride smelt is dissolved in recycled mother liquor from a previous sodium bicarbonate precipitation in the smelt dissolver 1, plus make-up water as required. The smelt solution is then passed to the reactor 2, in which carbon dioxide is charged at an elevated temperature above approximately 50° C. extending up to the boiling point of the solution. The following reaction takes place:

$$Na_2CO_3+CO_2+H_2O\rightarrow 2NaHCO_3$$

The aqueous solution from the reactor 2 is a saturated solution of sodium bicarbonate, containing some precipitated sodium bicarbonate, and containing sodium chloride in solution. This solution is passed to a cooler and separator, where the temperature is brought to below about 25° C., so as to precipitate sodium bicarbonate. The precipitated sodium bicarbonate crystals are separated in a centrifuge. The resulting mother liquor contains principally sodium chloride in solution, with a small amount of dissolved sodium bicarbonate, corresponding to that which can exist in solution at the precipitation temperature. A portion of this solution is recycled to the smelt dissolver, for the purpose of dissolving the sodium carbonate/sodium chloride smelt from the soda boiler. The remainder is withdrawn from the system, and can be processed for sodium bicarbonate recovery, for example, by fractional evaporation before discharge from the recovery system, or directly discharged from the recovery system.

The sodium bicarbonate which is separated is calcined at an elevated temperature of for example about 300° C., in the circulating air oven 4, so as to convert sodium bicarbonate to sodium carbonate and carbon dioxide. The following reaction takes place:

$$2NaHCO_3 \rightarrow Na_2CO_3 + CO_2 + H_2O$$

The carbon dioxide that is liberated is recycled to the reactor, for reuse in forming sodium bicarbonate, while the sodium carbonate is fed to the causticizer 5, and reacted with calcium hydroxide to form sodium hydroxide according to the following reaction:

$$Na_2CO_3 + Ca(OH)_2 \rightarrow 2NaOH + CaCO_3$$

This can be recycled for use as sodium hydroxide pulping liquor, and contains only small amounts of sodium carbonate and sodium chloride.

The following Example illustrates application of the process shown in the flow sheet of FIG. 1. In the Example, all quantities given are flow amounts, in kilograms per ton of pulp processed.

EXAMPLE 1

624 kgs of a sulfide-free smelt containing 84.9% $Na_2CO_3$, 14.1% NaCl and 1% heavy metal compounds and obtained by evaporating and then combusting in a soda boiler washing liquor from the filters of a soda pulping process when using spent liquor from the bleachery as washing liquor in the brown stock washing and containing 530 kgs sodium carbonate and 88 kgs sodium chloride is dissolved in the smelt dissolver 1 in a blend of 545 kgs make-up water and mother liquor recycled from the cooler and evaporator 3, after precipitation of sodium bicarbonate, and containing 2055 kgs water, 50 kgs sodium bicarbonate, and 398 kgs sodium chloride. The temperature in the smelt dissolver was 90° C. The mixed liquor fed to the reactor 2 had the following composition:

| | |
|---|---|
| Sodium carbonate | 530 kgs |
| Sodium bicarbonate | 50 kgs |
| Sodium chloride | 486 kgs |
| Water | 2600 kgs |

In the reactor 2, carbon dioxide was charged at a rate of 220 kgs, and reacted with the sodium carbonate at a temperature of about 90° C., to form sodium bicarbonate according to the following reaction:

$$Na_2CO_3 + CO_2 + H_2O \rightarrow 2NaHCO_3$$

The 220 kgs carbon dioxide was composed of 217 kgs recycled from the oven 4, and 3 kgs make-up carbon dioxide.

The solution from the reactor contained 770 kgs sodium bicarbonate, 486 kgs sodium chloride and 2510 kgs water.

After cooling to 25° C. to precipitate sodium bicarbonate, and separation of the precipitated sodium bicarbonate, most of the mother liquor (87%) was recycled to the smelt dissolver 1. The remaining 13% was removed from the system, and processed to recover sodium chloride. The solution removed contained 8 kgs sodium bicarbonate, 60 kgs sodium chloride and 310 kgs water.

708 kgs sodium bicarbonate was removed as precipitated crystals, together with an aqueous phase absorbed thereon of 4 kgs $NaHCO_3$, 28 kgs NaCl and 145 kgs $H_2O$. The crystals were centrifuged to 80% solids.

The sodium bicarbonate crystals were calcined at 300° C. in the oven 4, thereby converting sodium bicarbonate to sodium carbonate, and the carbon dioxide released was recycled to the reactor 2. The retention time in the oven 4 was 30 minutes. The sodium carbonate, 523 kgs, containing 28 kgs sodium chloride and 235 kgs water, was sent on to the causticizer 5 and reacted with calcium hydroxide to form sodium hydroxide.

The resulting cooking liquor contained 335 kgs sodium hydroxide, 52 kgs sodium carbonate and 28 kgs sodium chloride (equivalent approximately to 7.5 g per liter) and 3735 kgs water. The sodium chloride content of this liquor was well below the maximum of 10 g per liter that can be tolerated before corrosion problems begin to be significant. The white liquor was recycled for use as cooking liquor in the pulping process.

Figure 2:
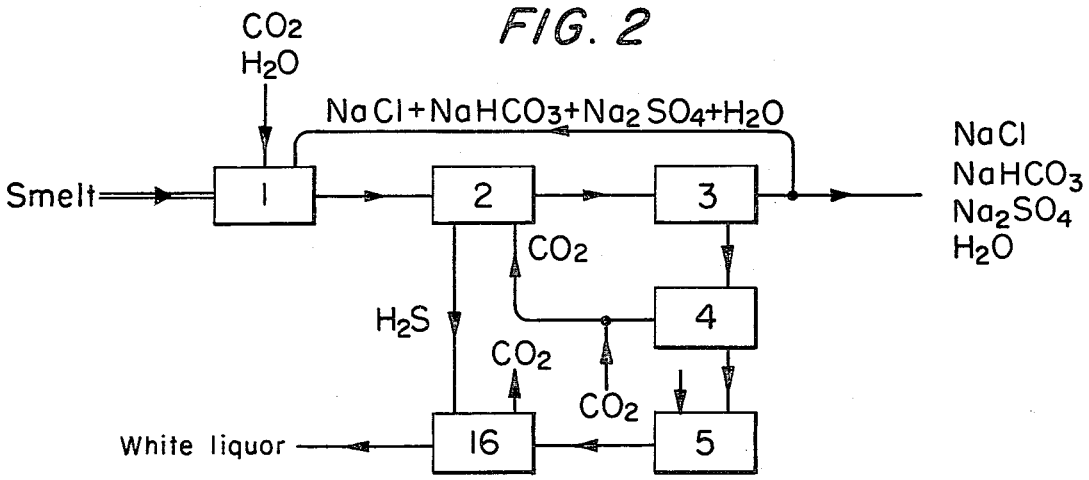
FIG. 2 is a flow sheet showing application of the process of the invention to a sodium sulfate pulping process.

In the flow sheet of FIG. 2, the process of the invention is applied to a sulfide-containing solution obtained in the Kraft pulping process. A sulfide containing smelt is obtained by recovery of washing liquor from the filters using waste liquor from the bleachery as washing liquor in the brown stock washing. The liquor is evaporated and then burned in a soda boiler to form the smelt (containing mainly sodium carbonate, sodium sulfate, sodium sulfide and sodium chloride), which is dissolved in the smelt dissolver 1 in a blend of water and an aqueous solution recycled from the cooler and separator 3 to form a green liquor. The green liquor is then fed to the reactor 2, in which it is reacted with carbon dioxide. The following reactions take place:

$$Na_2CO_3 + CO_2 + H_2O \rightarrow 2NaHCO_3$$

$$Na_2S + 2CO_2 + H_2O \rightarrow 2NaHCO_3 + H_2S$$

Hydrogen sulfide liberated in the reactor is sent on to the absorption tower or scrubber 6, in which it is contacted with alkaline liquor from the causticizer 5, and thus recovered as sodium sulfide. Thus, the reaction solution from the reactor 2 is sulfide-free.

The reaction mixture from the reactor 2 is composed of a saturated solution of sodium bicarbonate, containing preciptated crystals of sodium bicarbonate, and dissolved sodium chloride and sodium sulfate, and is passed on to the cooler and separator 3, where the temperature is reduced to precipitate sodium bicarbonate.

In the cooler and separator 3, solid sodium bicarbonate is precipitated and is separated. The major portion of the mother liquor is recycled to the smelt dissolver 1, for dissolution of the smelt. The remainder is removed from the system, and can be processed for chloride recovery, if desired.

The sodium bicarbonate separated from the cooler and separator is sent to the oven 4, in which it is calcined at an elevated temperature sufficient to convert sodium bicarbonate to sodium carbonate, according to the reaction:

$$2NaHCO_3 \rightarrow Na_2CO_3 + CO_2 + H_2O$$

The sodium carbonate is transferred to the causticizer 5, after the dissolution in water, and treated with calcium hydroxide to form sodium hydroxide, according to the following reaction:

$$Na_2CO_3 + Ca(OH)_2 \rightarrow 2NaOH + CaCO_3$$

The resulting sodium hydroxide solution is then led on to the scrubber 16, in which it is treated with hydrogen sulfide from the reactor 2 to form white liquor containing sodium hydroxide, sodium sulfide, a small amount of sodium sulfate and a small amount of sodium chloride, which can then be recycled to the pulping stage.

The following Example illustrates application of this embodiment of the process to a sulfide-containing Kraft pulping chemicals recovery solution. In the Example, all quantities given are flow amounts, in kilograms per ton of pulp processed.

EXAMPLE 2

696 kgs of a sulfide-containing smelt obtained by evaporation and combustion of the washing liquor from the filters in a Kraft pulping process, when using waste liquor from the bleachery as washing liquor in the brown stock washing and containing 58.5% sodium carbonate, 4.3% sodium sulfate, 26.6% sodium sulfide and 12.6% sodium chloride, and 1.0% heavy metal compounds, was dissolved in a blend of water and recycled sodium bicarbonate mother liquor. The smelt had the following composition:

| | |
|---|---|
| Sodium sulfide | 164 kgs |
| Sodium carbonate | 407 kgs |
| Sodium sulfate | 30 kgs |
| Sodium chloride | 88 kgs |

The solvent was composed of 600 kgs water, added as make-up, and a recycle solution containing 45 kgs sodium bicarbonate, 132 kgs sodium sulfate, 386 kgs sodium chloride and 2000 kgs water. The temperature of the solution in the smelt dissolver was kept at 90° C. The solution from the smelt dissolver 1 accordingly had the following composition:

| | |
|---|---|
| Sodium sulfide | 164 kgs |
| Sodium carbonate | 407 kgs |
| Sodium bicarbonate | 45 kgs |
| Sodium sulfate | 162 kgs |
| Sodium chloride | 474 kgs |
| Water | 2600 kgs |

This green liquor was fed to the reactor 2, which was kept at an elevated temperature of 90° C., while carbon dioxide was fed in at a rate of 354 kgs. This carbon dioxide was composed of 94 kgs make-up carbon dioxide and 260 kgs carbon dioxide from the oven 4. Hydrogen sulfide was liberated from the reactor at a rate of 71 kgs, and sent on to the scrubber for recovery as sodium sulfide.

The reaction solution from the reactor 2 had the following composition:

| | |
|---|---|
| Sodium bicarbonate | 1045 kgs |
| Sodium sulfate | 162 kgs |
| Sodium chloride | 474 kgs |
| Water | 2455 kgs |

This reaction solution was sent on to the cooler and separator 3, where it was cooled to about 15° C. A solid phase of sodium bicarbonate formed, corresponding to 988 kgs, and this was separated from the mother liquor. The mother liquor had the following composition:

| | |
|---|---|
| Sodium bicarbonate | 45 kgs |
| Sodium sulfate | 132 kgs |
| Sodium chloride | 386 kgs |
| Water | 2000 kgs |

About 89% of the mother liquor was recycled to the smelt dissolver 1, while the remaining 11% was removed from the system, thereby removing 6 kgs sodium bicarbonate, 17 kgs sodium sulfate, 49 kgs sodium chloride and 252 kgs water.

The solid sodium bicarbonate phase, containing about 25% mother liquor, was transferred without drying to the oven 4, in which it was heated to about 300° C., while running a small air flow through the oven. The retention time in the oven 4 was 30 minutes. Sodium carbonate was formed. The solid material from the oven had the following composition:

| | |
|---|---|
| Sodium carbonate | 626 kgs |
| Sodium sulfate | 13 kgs |
| Sodium chloride | 39 kgs |

This mixture was dissolved in water, and transferred to the causticizer 5, where it was treated with calcium hydroxide to form sodium hydroxide. The solution withdrawn from the causticizer had the following composition:

| | |
|---|---|
| Sodium hydroxide | 425 kgs |
| Sodium carbonate | 63 kgs |
| Sodium sulfate | 13 kgs |
| Sodium chloride | 39 kgs |
| Water | 3200 kgs |

This white liquor was sent on to the scrubber, where it was treated with hydrogen sulfide from the reactor at a rate of 71 kgs, thereby forming a white liquor suitable for recycling to the pulping stage and having the following composition:

| | |
|---|---|
| Sodium hydroxide | 305 kgs |
| Sodium sulfide | 164 kgs |
| Sodium sulfate | 13 kgs |
| Sodium chloride | 39 kgs |
| Water | 3200 kgs |

In this white liquor, the sodium chloride content was approximately 12.2 g per liter, an acceptable proportion for recycling.

Figure 3:
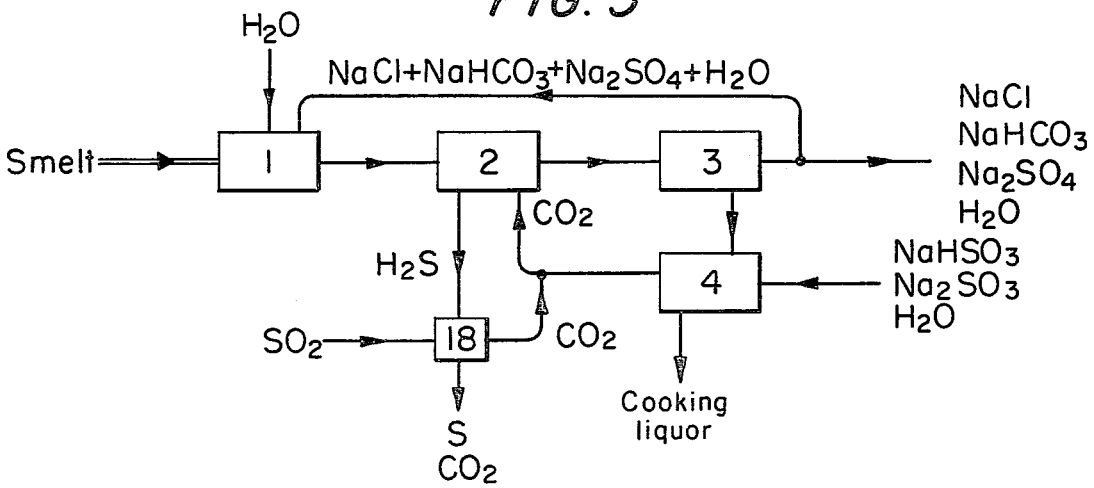
FIG. 3 is a flow sheet showing application of the process of the invention to a sodium sulfite pulping process.

In the flow sheet shown in FIG. 3, the process of the invention is applied to the sulfide-containing recycled liquor of a sulfite process, using the Stora recovery system.

The smelt, composed of sodium sulfide, sodium carbonate, sodium sulfate and sodium chloride, is dissolved in the smelt dissolver 1, in a blend of water and mother liquor solution recycled from the cooler and separator 3, and is then transferred to the reactor 2, where carbon dioxide from the reactor 4 is fed in. The following reactions take place in the reactor:

$$Na_2CO_3+CO_2+H_2O \rightarrow 2NaHCO_3$$

$$Na_2S+2CO_2+H_2O \rightarrow 2NaHCO_3+H_2S$$

The temperature in the reactor 2 is kept high enough so that all salts remain in solution. Hydrogen sulfide is liberated in the course of the reaction and is fed to a Claus reactor 18, where the hydrogen sulfide is converted to sulfur and carbon dioxide, by reaction with sulfur dioxide.

The aqueous solution from the reactor 2 contains sodium bicarbonate, sodium sulfate and sodium chloride, and is sent on to the cooler and separator 3, where it is cooled to a low enough temperature to precipitate sodium bicarbonate.

The mother liquor after separation of the precipitated sodium bicarbonate is partially recycled to the smelt dissolver, and partially removed from the system. What is removed can be processed if desired for sodium chloride, sodium bicarbonate and sodium sulfate recovery.

The sodium bicarbonate crystals from the cooler and separator are sent on to the reactor 4. Aqueous sodium bisulfite solution containing a small amount of sulfite is fed into the reactor 4, and reacted with the solid sodium bicarbonate crystals recovered from the cooler and separator 3. The following reaction takes place:

$$HCO_3^- + HSO_3^- \rightarrow CO_2 + H_2O + SO_3^=$$

Carbon dioxide removed as a byproduct is recycled to the reactor 2. From the reactor 4 is drawn off a cooking liquor composed of an aqueous solution of sodium sulfite, with small amounts of sodium sulfate and sodium chloride.

The following Example illustrates application of the process of the invention to this process. In the Example, all quantities given are flow amounts, in kilograms per ton of pulp processed.

EXAMPLE 3

Wash liquors from a sodium sulfite pulping process when using waste liquor from the bleachery as washing liquor in the brown stock washing were combined, evaporated and combusted in a soda boiler, forming a smelt having the following composition

| | Amount | % by Weight |
|---|---|---|
| Sodium sulfide | 100 kgs | 48.3 |
| Sodium carbonate | 40 kgs | 19.3 |
| Sodium sulfate | 15 kgs | 7.2 |
| Sodium chloride | 50 kgs | 24.2 |
| Heavy metal compounds | | 1.0 |

207 kgs of this smelt was dissolved in the smelt dissolver 1 in a mixture of 252 kgs make-up water and mother liquor recycled from the cooler and separator 3 having the following composition:

| | |
|---|---|
| Sodium bicarbonate | 18 kgs |
| Sodium sulfate | 44 kgs |
| Sodium chloride | 148 kgs |
| Water | 748 kgs |

The temperature of the solution in the smelt dissolver was kept at 90° C.

The solution from the smelt dissolver was fed to the reactor 2, and had the following composition:

| | |
|---|---|
| Sodium sulfide | 100 kgs |
| Sodium carbonate | 40 kgs |
| Sodium bicarbonate | 18 kgs |
| Sodium sulfate | 59 kgs |
| Sodium chloride | 198 kgs |

-continued

| | |
|---|---|
| Water | 1000 kgs |

The temperature in the reactor 2 was kept at 90° C., and carbon dioxide fed in at a rate of 422 kgs, made up of 280 kgs from the Claus reactor 18 and 142 kgs from the reactor 4. In the course of the reaction, hydrogen sulfide was liberated and fed to the Claus reactor 18 at a rate of 43 kgs, together with 53 kgs water.

The reaction solution contained sodium bicarbonate, sodium sulfate and sodium chloride, and had the following composition:

| | |
|---|---|
| Sodium bicarbonate | 296 kgs |
| Sodium sulfate | 59 kgs |
| Sodium chloride | 198 kgs |
| Water | 1000 kgs |

This solution was fed to the cooler and separator 3, where it was cooled to 15° C., so that sodium bicarbonate precipitated, in the form of crystals. These were separated at a rate of 272 kgs.

The mother liquor was split. 79% was recycled to the smelt dissolver 1, and 21% was removed from the system, so that sodium chloride was removed at a rate of 40 kgs together with sodium bicarbonate 4.7 kgs, sodium sulfate 12 kgs and water 199 kgs.

The sodium bicarbonate crystals were centrifuged to 75% solids, and included as absorbed mother liquor 1.3 kg $NaHCO_3$, 3 kgs $Na_2SO_4$, 10 kgs NaCl and 53 kgs $H_2O$.

The sodium bicarbonate crystals were led to the reactor 4, where the sodium bicarbonate was dissolved in an aqueous solution containing 337 kgs sodium bisulfite, 16 kgs sodium sulfite and 2700 kgs water. The carbon dioxide liberated was recycled to the reactor 2. The solution formed in the reactor 4 was suitable for recycling as a sulfite cooking liquor, and had the

| | |
|---|---|
| composition: | |
| Sodium sulfite | 424 kgs |
| Sodium sulfate | 3 kgs |
| Sodium chloride | 10 kgs |
| Water | 2700 kgs |

The temperature of the solution was 80° C. This corresponded to 3.7 g per liter of sodium chloride, well below the limit at which corrosion begins to be a problem.

In the Claus reactor, sulfur dioxide was fed in at a rate of 41 kgs and sulfur produced at a rate of 61 kgs. Carbon dioxide was released at a rate of 280 kgs and recycled to the reactor 2. Approximately 12 kgs carbon dioxide was lost with the sulfur from the reactor.

As is apparent from the flow sheets and the Examples, the process of the invention is applicable to sodium chloride removed in the sodium chemicals recovery from any waste liquor from a pulp manufacturing process containing sodium chloride and other sodium salts, such as sodium hydroxide, sodium carbonate, sodium bicarbonate, sodium sulfate and sodium sulfide. The treatment with carbon dioxide converts any sodium salt more alkaline than $NaHCO_3$, such sodium hydroxide, sodium carbonate, and sodium sulfide, to sodium bicarbonate, while leaving the sodium chloride unaffected. In the case of sodium sulfide, the increased acidity results in the expulsion of hydrogen sulfide, which can also be recovered and recycled to form sodium sulfide from sodium hydroxide, carbonate or bicarbonate at a later pulping chemicals regeneration stage. Consequently, all such sodium values are recovered as sodium bicarbonate in the process, and the sodium bicarbonate is recycled to the pulping and/or bleaching chemicals regeneration stage for causticization or other conversion to an active chemical.

The process of the invention is applicable to the recovery of sodium values and the withdrawal of sodium chloride from any sodium chemicals containing waste liquor arising from any stage in a pulp manufacturing process, including waste liquors from the pulping stage, waste liquors from the bleaching stage, and wash waters and liquors from such stages. The wash liquors from the washing of the pulp in the pulp recovery, screening and washing stages of a pulp manufacturing process can be processed by the invention; so also can waste bleaching liquors and washing liquors from washing the bleached pulp be processed by the invention. The waste liquor is first processed to remove organic materials, where they are not readily combusted. The residual liquor is then evaporated, and combusted to form an inorganic smelt containing sodium salts present in the liquor or derived therefrom during combustion.

The reaction with carbon dioxide can be carried out at room temperature, but a faster reaction is obtained at elevated temperatures. Normally, the reaction temperature is within the range from about 50° to about 100° C., and preferably within the range from about 60° C. to about 90° C. Since an excess of carbon dioxide is not deleterious, it is normally convenient to operate the reaction by continuously bubbling carbon dioxide through the system, and recycling the carbon dioxide that does not react. In this mode of operation, if hydrogen sulfide is liberated, it will be carried off with the excess carbon dioxide from the reactor. The carbon dioxide can be separated and the hydrogen sulfide passed off to the white liquor regeneration stage.

Following the conversion to sodium bicarbonate, the sodium bicarbonate is separated from the solution by precipitation, under conditions such that sodium chloride does not precipitate, but remains in solution. Under such conditions, there is always of course a small amount of sodium bicarbonate remaining in solution as well, the equilibrium amount present in solution in a saturated solution of sodium bicarbonate, at the precipitation temperature.

The precipitated sodium bicarbonate can be removed by any convenient means, such as filtration, or centrifuging, or decantation, and the residual supernatant or mother liquor is then further processed.

The process is designed to maintain any desired low sodium chloride content in the recycled sodium chemicals simply by removal of the residual sodium chloride solution from the system. Consequently it is important to withdraw enough of the mother liquor from the system to reduce the sodium chloride to the required level. The remainder of the mother liquor can be recycled for smelt dissolution. This is the stage therefore at which sodium chloride is removed from the process, and the amount of sodium chloride that is removed is normally that required to maintain the acceptable low proportion of sodium chloride in the recycled chemicals, i.e., sodium bicarbonate, prior to further processing of such chemicals in the recovery system.

In most sodium-based pulp manufacturing processes, it is important that the sodium chloride content be less than 25 g per liter, and preferably less than 10 g per liter. At a proportion below 25 g per liter, corrosion problems are held to a minimum. In a proportion below 10 g per liter, corrosion is negligible, and therefore this low proportion is preferred, but it is not always practical to maintain it, particularly when chloride-containing bleaching liquors and other liquors high in chlorides are also being recycled in the sodium chemicals recovery process.

It is desirable to withdraw no more than necessary of the mother liquor, since the mother liquor can be recycled for dissolution of the smelt that is obtained by evaporation and combustion of the liquor being processed. If the amount of recycled mother liquor be insufficient for dissolution, make-up water can be added, in the amount required to obtain full dissolution. However, the smelt solution should be as concentrated as possible, and should have a sodium chloride concentration not exceeding about 20%, and preferably about 15%, or from about 100 to about 200 g per liter, in order to maintain sodium chloride in solution during the sodium bicarbonate precipitation step.

The sodium bicarbonate recovered from the precipitation stage can then be processed for conversion to the alkaline sodium chemical desired for regeneration of the pulping or bleaching liquor. In a sulfate process, the sodium bicarbonate should be converted to a mixture of sodium hydroxide and sodium sulfide. In a soda pulping process, the sodium bicarbonate should be converted to sodium hydroxide or sodium carbonate, or a mixture of both. In a sulfite pulping process, the sodium bicarbonate should be converted to sodium bisulfite or sodium sulfite, or a mixture thereof, as required.

Such conversions are conventional in sodium chemicals recovery systems, and form no part of the invention. Three types of conversions that can be used are illustrated in the flow sheets of FIGS. 1 to 3, and other variations will be apparent to those skilled in the art.

Where the pulp manufacturing process uses sodium sulfide or sodium hydrosulfide in the pulping liquor, the hydrogen sulfide liberated in the reaction with carbon dioxide is recovered and recycled to the white liquor regeneration stage, where it is combined with the white liquor, for conversion of alkaline sodium values, such as sodium hydroxide or sodium carbonate, to sodium sulfide or hydrosulfide. Losses of hydrogen sulfide can be replenished by adding make-up hydrogen sulfide, as required.

The precipitation of sodium bicarbonate is carried out at as low a temperature as possible, taking into consideration the energy costs for cooling large amounts of liquors to low temperatures. A convenient inexpensive system for a pulp mill in a northern country is to simply chill the solution outdoors to a suitable low temperature, above the freezing point of the solution, and generally within the range from about 2° to about 15° C. At 0° C., the solubility of sodium bicarbonate is only 6.9 g in 100 parts of water, and at these temperatures therefore a satisfactory recovery of sodium values from the reaction solution will be obtained, with only small losses of sodium bicarbonate in the mother liquor. At 60° C., the solubility of sodium bicarbonate is 16.4 g per 100 parts of water, which is a little high, and therefore it is normally preferred that the precipitation be carried out at a temperature below at least 35° C.

Accordingly, in order to minimize sodium bicarbonate losses in the mother liquor, it is desirable to carry out the reaction with carbon dioxide in an amount of water sufficiently low to provide a saturated solution of sodium bicarbonate even at the carbon dioxide reaction temperature.

Also removed in the mother liquor with sodium chloride are other salts not reactive with carbon dioxide under the reaction conditions and more soluble in the liquor than sodium bicarbonate, such as sodium sulfate. These can be separated from the sodium chloride by fractional crystallization, and recycled to the chemicals recovery for causticization or other conversion and recycled.

Having regard to the foregoing disclosure, the following is claimed as inventive and patentable embodiments thereof:

1. In the cyclic process for the recovery of sodium chemicals in sodium-based pulp manufacturing process, which comprises the steps of combusting a sodium-chemical-containing waste liquor to form a sodium-chemical-containing smelt containing sodium salts including sodium chloride present in the waste liquor or derived therefrom during combustion; dissolving the smelt in an aqueous mother liquor to dissolve sodium salts including sodium chloride; treating the resulting solution of sodium salts with carbon dioxide gas, thereby forming a saturated sodium bicarbonate solution, and precipitating sodium values of the solution as sodium bicarbonate while maintaining sodium chloride in solution; and separating and recycling sodium bicarbonate to the pulp manufacturing process and mother liquor to the dissolving step, the improvement which comprises maintaining a sodium chloride content in the mother liquor recycled to the dissolving step below about 200 g per liter at which sodium chloride would precipitate during carbon dioxide treatment, by withdrawing from the cyclic process a portion of the sodium chloride-containing mother liquor after removal of sodium bicarbonate, and recycling the remainder of the sodium-containing mother liquor to the dissolving step.

2. A process in accordance with claim 1, which comprises withdrawing a sufficient amount of mother liquor to maintain a sodium chloride content in the recycled sodium chemicals below 25 g per liter.

3. A process in accordance with claim 1, which comprises withdrawing a sufficient amount of mother liquor to maintain a sodium chloride content in the recycled sodium chemicals below 10 g per liter.

4. A process in accordance with claim 1 which comprises converting the separated sodium bicarbonate to sodium hydroxide, forming aqueous sodium hydroxide solution, and recycling the solution to the pulp manufacturing process.

5. A process in accordance with claim 1, which comprises converting the separated sodium bicarbonate to sodium carbonate, forming aqueous sodium carbonate solution, and recycling the solution to the pulp manufacturing process.

6. A process in accordance with claim 1, which comprises converting the separated sodium bicarbonate to sodium hydroxide, forming aqueous sodium hydroxide and sodium sulfide solution, and recycling the solution to the pulp manufacturing process.

7. A process in accordance with claim 1, which comprises reacting the separated sodium bicarbonate with an aqueous sodium bisulphite solution to form sodium sulphite, and recycling the sodium sulphite solution to the pulp manufacturing process.

8. A process in accordance with claim 1, in which the mother liquor contains sodium sulphide, hydrogen sulphide is liberated in the course of the treatment with carbon dioxide, sodium bicarbonate separated from the sodium chloride solution is converted to sodium hydroxide, and the sodium hydroxide dissolved in water to form sodium hydroxide solution, and the hydrogen sulfide is reacted with the sodium hydroxide solution to form sodium sulphide therein in situ.

9. A process in accordance with claim 1, in which the mother liquor contains sodium sulphide, hydrogen sulphide is liberated in the course of the treatment with carbon dioxide, hydrogen sulphide is reacted with sulfur dioxide to form sulfur and carbon dioxide, the carbon dioxide is recycled to the carbon dioxide treatment while the sulfur is converted to sulfur dioxide, the sulfur dioxide is reacted with sodium bisulphite in aqueous solution to form sodium sulphite, the sodium sulphite is reacted with the recycled sodium bicarbonate and recycled as sulphite cooking liquor to the pulp manufacturing process.

* * * * *